US008066950B2

(12) United States Patent
Newburry et al.

(10) Patent No.: US 8,066,950 B2
(45) Date of Patent: Nov. 29, 2011

(54) CATALYTIC CONVERTER SYSTEM AND ELEMENT FOR DIESEL ENGINES

(75) Inventors: Donald M. Newburry, Broken Arrow, OK (US); Juan Carlos Uribe, Tulsa, OK (US); Joshua Neil Thompson, Tulsa, OK (US); Donald Christopher Lambert, Tulsa, OK (US); Daniel Alan Farrington, Tulsa, OK (US); Rachel Elizabeth Stephens, Tulsa, OK (US); John W. Sartain, Broken Arrow, OK (US)

(73) Assignee: Miratech Holdings, LLC, Tulsa, OK (US)

( * ) Notice: Subject to any disclaimer, the term of this patent is extended or adjusted under 35 U.S.C. 154(b) by 912 days.

(21) Appl. No.: 12/059,472

(22) Filed: Mar. 31, 2008

(65) Prior Publication Data

US 2008/0229733 A1 Sep. 25, 2008

Related U.S. Application Data

(63) Continuation-in-part of application No. 11/311,868, filed on Dec. 19, 2005, now Pat. No. 7,412,824.

(51) Int. Cl.
*B01D 50/00* (2006.01)

(52) U.S. Cl. ..... 422/180

(58) Field of Classification Search ..... 422/179, 422/180

See application file for complete search history.

(56) References Cited

U.S. PATENT DOCUMENTS

| | | | |
|---|---|---|---|
| 2,423,602 | A | 7/1947 | Magdeburger |
| 3,644,098 | A | 2/1972 | De Palma et al. |
| 4,091,616 | A | 5/1978 | Loweg |
| 4,151,717 | A | 5/1979 | Katsumoto et al. |
| 4,748,807 | A | 6/1988 | Vladimir |
| 4,758,410 | A | 7/1988 | Grimm et al. |
| 5,209,062 | A | 5/1993 | Vollenweider |
| 5,373,630 | A | 12/1994 | Lucier et al. |
| 5,388,407 | A | 2/1995 | Capers et al. |
| 5,722,237 | A | 3/1998 | Iida et al. |
| 6,082,103 | A | 7/2000 | Sugiura et al. |
| 6,151,890 | A | 11/2000 | Hoshi |
| 6,622,481 | B1 | 9/2003 | Ruman et al. |
| 6,837,335 | B2 | 1/2005 | Jankowski |
| 6,976,479 | B1 | 12/2005 | Gottemoller et al. |
| 7,157,060 | B1 | 1/2007 | Newburry |
| 7,290,391 | B2 | 11/2007 | Rezabek |

(Continued)

OTHER PUBLICATIONS

International Search Report for PCT/US2008/080138.

*Primary Examiner* — Tom Duong
(74) *Attorney, Agent, or Firm* — Fellers, Snider, Blankenship, Bailey & Tippens, P.C.; Dennis D. Brown

(57) ABSTRACT

An improved exhaust system and catalytic converter element for a diesel engine wherein the improvement comprises: holding means for restricting the movement of catalytic converter elements in an overhead exhaust manifold; an improved catalytic converter element having at least one retaining rod extending through the catalyst substrate and/or having at least one retaining lip projecting into the substrate; a stabilizer projecting from the cover for the element insertion slot for receiving an end portion of the catalytic converter element to restrict the movement of the converter element in the exhaust manifold; perforated flow distribution elements provided upstream of the catalytic converter elements; and/or vertical coupling manifolds which each receive exhaust from a pair of engine cylinders and then deliver the combined exhaust stream to a separate one of the inlet openings in the bottom of the overhead exhaust manifold.

2 Claims, 11 Drawing Sheets

U.S. PATENT DOCUMENTS

| | | | | |
|---|---|---|---|---|
| 7,410,621 | B2 | 8/2008 | Muter et al. | |
| 7,919,052 | B2 * | 4/2011 | Ahmed | 422/179 |
| 2002/0083703 | A1 | 7/2002 | Werth et al. | |
| 2005/0271561 | A1 | 12/2005 | Lancaster et al. | |
| 2006/0096273 | A1 | 5/2006 | Soliman et al. | |
| 2007/0209544 | A1 | 9/2007 | Caro et al. | |

* cited by examiner

CATALYTIC CONVERTER SYSTEM AND ELEMENT FOR DIESEL ENGINES

This is a continuation-in-part application of U.S. patent application Ser. No. 11/311,868, filed Jan. 19, 2005, which application is incorporated herein in its entirety by reference.

FIELD OF THE INVENTION

The present invention relates to catalytic converters and catalytic converter elements for diesel engines having overhead exhaust manifold systems.

BACKGROUND OF THE INVENTION

Two-stroke and four stroke medium speed diesel engines such as those manufactured by Electromotive Diesels (EMD) of LaGrange, Ill. (formerly a division of General Motors) are used in locomotives, in power generating systems, and in marine propulsion applications. An example of one common type of diesel engine, depicted in FIG. 1, is an EMD 645 E-16 two-stroke, "roots-blown" engine having an exhaust system which comprises an elongated overhead exhaust manifold 4 which runs horizontally above the centerline of the engine 2. The overhead manifold 4 receives exhaust gas via a series of pairs of opposing manifold legs 6 which extend upwardly to the bottom of the horizontal exhaust manifold 4 from the individual cylinder exhaust ports of the engine 2. The exhaust from the vertical manifold legs 6 collects in the horizontal exhaust manifold 4 and flows out of the exhaust manifold 4 via one or more (typically a plurality of) exhaust stacks 3.

As is also known in the art, another common type of diesel engine is a turbocharged engine which is similar to the roots-blown engine 2 depicted in FIG. 1 except that the exhaust collected in the horizontal overhead exhaust manifold of the turbocharged engine flows from one of the longitudinal ends of the horizontal overhead exhaust manifold to a turbocharger.

Turbocharged and roots-blown diesel engines typically have either 8, 12 or 16 cylinders arranged in a V configuration. Consequently, the manifold legs 6 of the exhaust system extend upwardly from the cylinder ports to the overhead exhaust manifold 4 in a series of four, six or eight opposing pairs. The overhead exhaust manifold 4 is typically formed of a series of manifold sections 10 such that two opposing pairs of the manifold legs 6 are connected to each manifold section 10. Each manifold section 10 also typically includes a flange 12 on one or both of the longitudinal ends thereof for bolting to flanged expansion joints positioned between the other manifold sections 10.

A need presently exists for an effective catalytic converter system for treating the exhaust gas from diesel engines. The application of catalytic converter devices to the exhaust systems of two-stroke and four-stroke diesel engines has been difficult for several reasons. In many cases, particularly in locomotive applications, there is not sufficient space around the engine for installation of a catalytic converter system. In addition, the temperature of the exhaust from two-stoke and four-stroke engines is relatively low in terms of the temperature necessary to "light-off" the catalyst to initiate and maintain the conversion reaction. Further, these engines have a relatively high lube oil consumption rate. In addition, it is difficult in locomotive and other applications to remove the exhaust manifolds from the engines due to a lack of sufficient overhead space for the lifting equipment. Also, the back pressure limits of the turbocharged diesel engines are typically very low.

SUMMARY OF THE INVENTION

The present invention provides an improved exhaust system which is well suited for use on diesel engines of the type discussed above. The inventive system satisfies the needs and alleviates the various problems already mentioned. The inventive system allows the integration of the diesel oxidation catalyst into the exhaust manifold system without significantly disturbing exhaust flow. In addition, the inventive system provides a large catalytic surface contact area which produces efficient emissions reduction while maintaining a low back pressure. Moreover, the inventive system does not require any significant amount of additional space, does not block the engine access covers, and does not interfere with engine maintenance. Also, the catalytic elements of the inventive system are easily removable for inspection and replacement without dismantling any portion of the exhaust manifold.

In one aspect, there is provided an improved exhaust system for a diesel engine wherein the exhaust system includes a series of pairs of upwardly extending exhaust port legs having upper outlet ends for delivering exhaust into an overhead exhaust manifold extending substantially horizontally over the diesel engine. The improvement comprises a plurality of catalytic converter elements removably positionable in the overhead exhaust manifold over the upper outlet ends of the exhaust port legs.

In another aspect, the improvement to the exhaust system preferably comprises a separate one of the catalytic converter elements being removably positionable in the overhead exhaust manifold over each of the upper outlet ends of the exhaust port legs. Further, the improvement preferably comprises the catalytic converter elements being removably positionable in the overhead exhaust manifold in opposing pairs, each of the opposing pairs of the catalytic converter elements forming a lateral V arrangement.

In another aspect, there is provided an improved overhead exhaust manifold segment for a diesel engine wherein the exhaust manifold segment has a longitudinal interior passage, a longitudinal wall surrounding the longitudinal interior passage, and a plurality of openings in a lower portion of the longitudinal wall for receiving an engine exhaust. The improvement comprises one or more catalytic converter elements removably insertable in the overhead exhaust manifold segment in a manner effective such that the engine exhaust will flow through the one or more catalytic converter elements into an upper longitudinal portion of the interior passage.

In another aspect, the improvement to the overhead exhaust manifold segment preferably further comprises four of the catalytic converter elements being insertable in the overhead exhaust manifold segment in two opposing pairs. In addition, the improvement preferably comprises the four catalytic converter elements being insertable in the overhead exhaust manifold segment in a manner such that each of the opposing pairs forms a lateral V arrangement.

In another aspect, there is provided an exhaust system for a diesel engine comprising an overhead exhaust manifold extending substantially horizontally over the diesel engine, the overhead exhaust manifold having a longitudinal outer wall and a plurality of openings through a longitudinal bottom portion of the longitudinal outer wall for receiving an engine exhaust. The improvement comprises: (a) a plurality of catalytic converter elements insertable in the overhead exhaust manifold through insert openings in the longitudinal outer wall in a manner effective such that the engine exhaust will flow through the catalytic converter elements into a longitudinal interior flow passage in the overhead exhaust manifold;

(b) element holding slots positioned in the overhead exhaust manifold for receiving the catalytic converter elements when the catalytic converter elements are inserted through the insert openings; and (c) holding means for holding the catalytic converter elements in the holding slots. Examples of suitable holdings means include: (a) one or more biasing springs (e.g., leaf springs); (b) two or more bolts extending through opposing side rails of the element holding slots; and/or (c) at least one cam element which is rotatable for locking engagement with the catalytic converter element.

In another aspect, there is provided a catalytic converter element comprising a substrate having at least one catalytic material thereon and a retainer (e.g., a band or frame) at least partially surrounding the substrate. The improvement comprises at least one retaining rod extending through the substrate, the retaining rod having a first end secured to the retainer at a first location and a second end secured to the retainer at a second location.

In another aspect, there is provided a catalytic converter element comprising a substrate having at least one catalytic material thereon and a retainer at least partially surrounding the substrate. The improvement comprises at least one retaining lip extending along at least a segment of the retainer such that the retaining lip projects from the retainer into the substrate.

In another aspect, there is provided an apparatus for treating an engine exhaust stream comprising: an exhaust manifold; at least one catalytic converter element insertable in the exhaust manifold through an insert opening in the exhaust manifold; and a cover positionable on the insert opening for closing the insert opening. The cover includes a stabilizer wherein, when the catalytic converter element is inserted into the exhaust manifold and the cover is positioned on the insert opening, the stabilizer will be received on an outer end portion of the catalytic converter element in a manner effective for restricting movement of the catalytic converter element in the exhaust manifold.

In another aspect, there is provided an exhaust system for a diesel engine comprising an overhead exhaust manifold extending substantially horizontally over the diesel engine, the overhead exhaust manifold having a plurality of openings through a longitudinal bottom portion of the overhead exhaust manifold for receiving an engine exhaust. The improvement comprises: (a) a plurality of catalytic converter elements insertable in the overhead exhaust manifold in a manner effective such that the engine exhaust will flow through the catalytic converter elements into a longitudinal interior flow passage in the overhead manifold and (b) a plurality of flow distributors positioned in the overhead exhaust manifold between the openings and the catalytic converter elements. The flow distributors have a plurality of flow perforations therein such that the engine exhaust must first flow through the flow perforations before reaching the catalytic converter elements.

In another aspect, there is provided an exhaust system for a diesel engine comprising an overhead exhaust manifold extending substantially horizontally over the diesel engine, the overhead exhaust manifold having a plurality of openings through a longitudinal bottom portion of the overhead exhaust manifold. The improvement comprises: (a) a plurality of catalytic converter elements insertable in the overhead exhaust manifold in a manner effective such that an engine exhaust received through the openings will flow through the catalytic converter elements into a longitudinal interior flow passage in the overhead exhaust manifold and (b) a plurality of vertical coupling manifolds wherein a separate one of said vertical coupling manifolds extends from each one of the openings. Each vertical coupling manifold is configured to receive the engine exhaust from a pair of cylinders of the diesel engine to form a combined exhaust stream and to deliver the resulting combined exhaust stream from the pair of cylinders to one of the openings.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
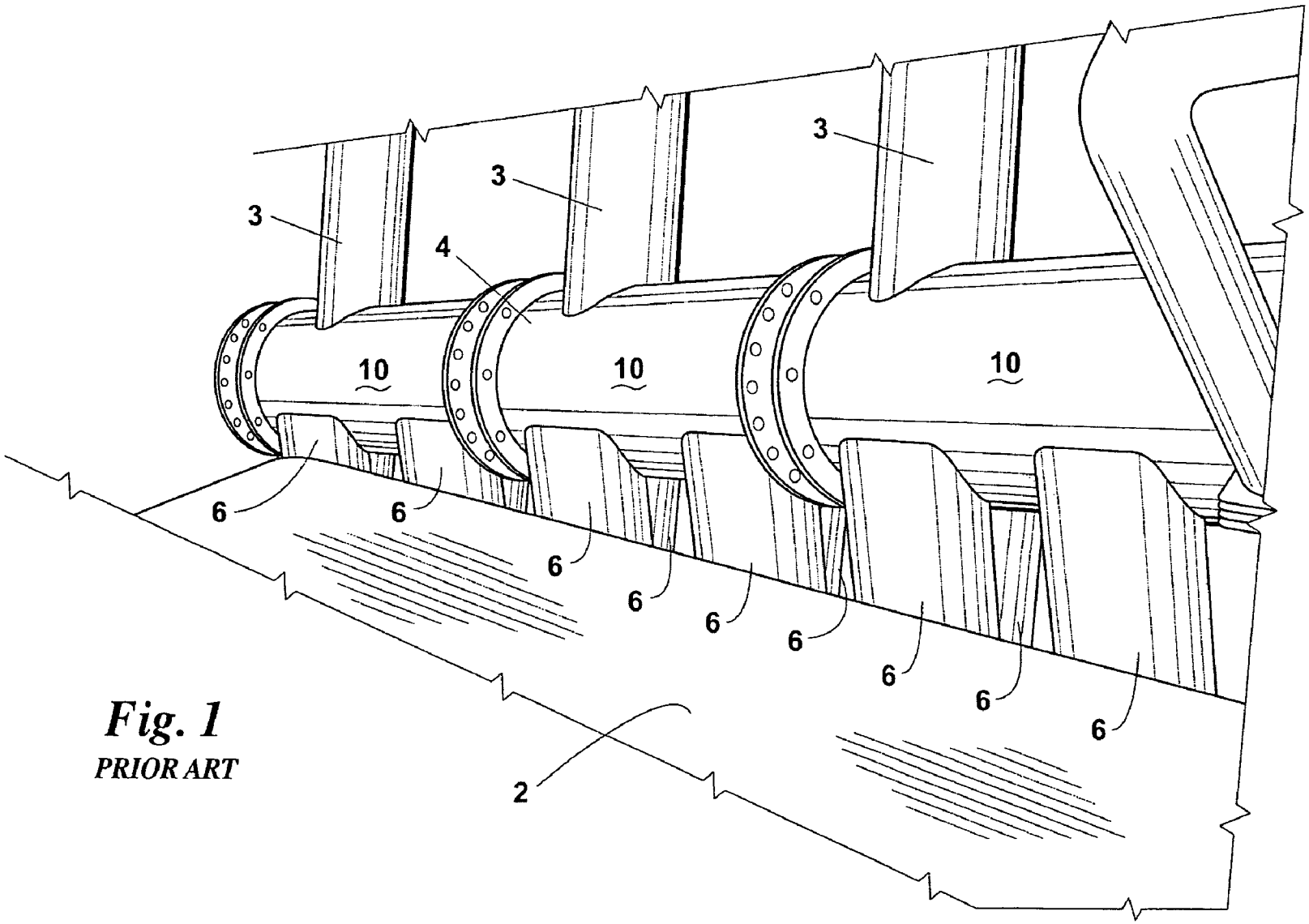
Fig. 1 PRIOR ART
FIG. 1 is a perspective view of a prior art overhead exhaust system of an Electromotive Diesels (EMD) roots-blown, two-stroke diesel engine 2.
Figure 2:
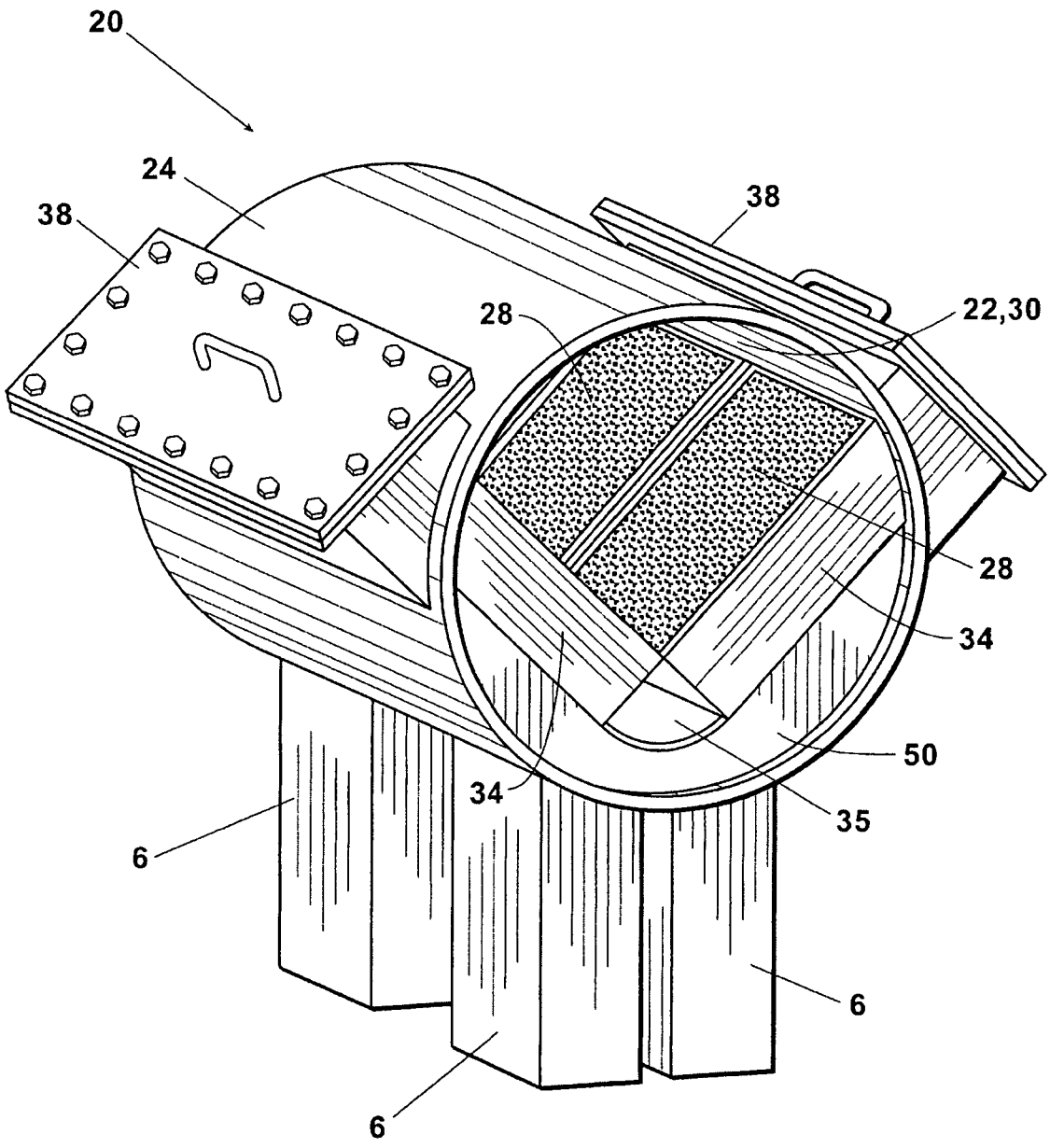
FIG. 2 is a partially cutaway perspective view of an inventive, improved exhaust manifold segment 20 which improves and replaces the manifold segments 10 of the prior art overhead exhaust manifold 4 shown in FIG. 1.
Figure 3:
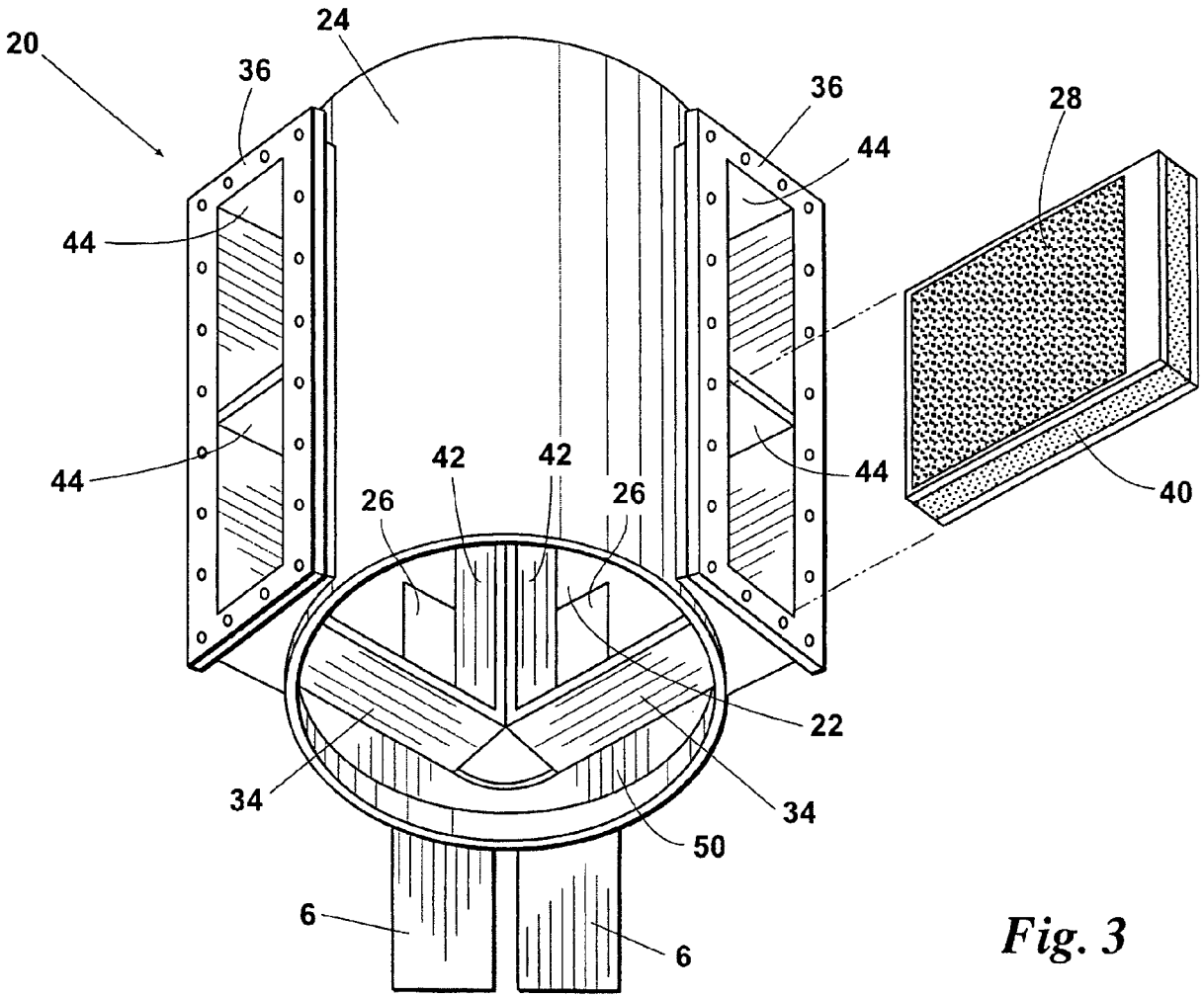
FIG. 3 is a top, partially cutaway perspective view of the inventive improved overhead manifold segment 20.

An embodiment 20 of an improved overhead exhaust manifold segment for a diesel engine exhaust system is depicted in FIGS. 2 and 3. The inventive manifold segment 20 improves and replaces the overhead manifold segments 10 presently used in the overhead exhaust systems of roots-blown, turbocharged, or other types of diesel engines.

The inventive manifold segment 20 comprises: a longitudinal interior passage 22; a longitudinal outer cylindrical wall 24 which surrounds the internal passage 22; a plurality of (preferably at least two and most preferably four) openings 26 in the bottom of the cylindrical wall 24 which are in fluid communication with the upper outlet ends of the manifold legs 6 extending from the engine cylinder exhaust ports; and one or more (preferably a plurality of) catalytic converter elements 28 which are removably insertable in the longitudinal passage 22 such that substantially all of the engine exhaust gas received in the overhead exhaust manifold via the vertical manifold legs 6 will flow through the catalytic converter element(s) 28 into an upper longitudinal portion 30 of the longitudinal interior passage 22. The upper longitudinal portion 30 of the exhaust manifold above the converter element (s) 28 provides a longitudinal interior flow discharge passage for the treated exhaust.

The catalytic converter element(s) 28 will preferably comprise a diesel oxidation catalyst on a metal foil substrate. Catalysts and catalyst substrates of this type are known in the art and are available, for example, from EcoCat Oy. Such catalysts and catalyst substrates are also described, for example, in Heikki Tuomola, et al., "A New Metallic Catalyst", SAE Technical Paper Series, 2002. The substrate can be constructed of layers of corrugated foil with angled channels which are spot welded or otherwise welded together. Alternatively, the layers of foil substrate can be brazed together and to the retainer (e.g., the retaining band or frame) 54 which surrounds the substrate.

Each catalytic converter element 28 will preferably comprise a durable metal foil substrate (e.g., preferably EcoXell or Vortex) which is resistance welded together in a solid block configuration. This construction helps the element 28 withstand the high exhaust pressure pulsations produced at the discharge of each engine cylinder. The substrate is preferably coated with a sulfur tolerant, alumina-based washcoat impregnated with an active catalyst material (preferably platinum) for oxidation of diesel exhaust. Examples of alternative oxidation catalyst materials include, but are not limited to, palladium and rhodium.

The catalytic converter element(s) 28 can also include other catalytic materials in combination with or instead of the oxidation catalyst material. Examples of other catalytic materials include, but are not limited to: selective catalytic reduction coatings such as vanadium oxide, titanium oxide, or zeolites; $NO_x$ adsorber catalyst coatings; and hydrocarbon SCR coatings.

The catalytic converter element(s) 28 can also be formed using, or be replaced with, alternative types of substrate materials and/or filter systems. Examples of other suitable substrate materials or systems include, but are not limited to: extruded ceramic monoliths such as those formed of cordierite or silicon carbide; wall flow diesel particulate filters such as those which are also formed of cordierite or silicon carbide; or metal mesh substrates such as those used in partial flow filters.

The inventive manifold segment 20 preferably further comprises one or more track slots 34 or other types of slots which extend into the longitudinal interior passage 22 for removably receiving and holding the catalytic converter elements 28. The elements 28 can be any desired shape but are preferably rectangular. The track slots 34 for the elements 28 preferably have a corresponding U-shape and comprise an opposing pair of track side rails 44. Flanged openings 36 are provided through the manifold segment wall 24 at the outer ends of the slots 34 for receiving and removing the catalytic converter elements 28. Covers 38 are removably attachable to the flanged openings 36 using bolts or other suitable attachments for closing the flanged openings 36. A sealing gasket 40 is preferably attached around the perimeter of each of the catalytic converter elements 28 for sealing against the bottom wall 42 and side rails 44 of the U-shaped slots 34 and for sealing against the inner surfaces of the covers 38.

The inventive manifold segment 20 can use a single catalytic element 28, a series of at least two catalytic elements 28, or one or more pairs of opposing catalytic elements 28. If a single element 28 or a series of single elements 28 is/are used, each element can be positioned at any desired orientation ranging from horizontal to vertical but will preferably be inserted laterally in a substantially horizontal orientation. If one of more pairs of opposing elements 28 are used, each pair will preferably be inserted in an upright V arrangement as illustrated in FIGS. 2 and 3. However, the pairs of elements 28 can alternatively be inserted in a horizontal arrangement, a lateral inverted V arrangement, a parallel vertical arrangement, or at any other desired orientation. Further, regardless of the arrangement or orientation used, each individual element 28 can be replaced with a stack of two or more catalyst elements having any desired combination of catalyst, substrate, and/or filter materials.

In addition, rather than having pairs of openings 26 in the bottom thereof wherein each individual opening 26 receives exhaust from a separate engine cylinder, the inventive manifold segment can alternatively have a smaller number of larger openings 26 such that at least some of the openings 26 receive exhaust from more than one engine cylinder.

Although generally any number of catalytic converter elements 28 could be used in the inventive manifold segment 20, the inventive manifold segment 20 most preferably includes two pairs of opposing slots 34 which hold a total of four catalytic converter elements 28. The inventive manifold segment 20 thus most preferably provides separate catalytic converter elements 28 positioned over each of the exhaust gas openings 26 in the bottom of the manifold segment 20. Additionally, each opposing pair of slots 34 and the corresponding pair of catalytic converter elements 28 positioned therein preferably form an upright V arrangement as illustrated in FIGS. 2 and 3.

Although cut away to some extent in FIGS. 2 and 3 to allow better viewing of the internal components of the inventive manifold segment 20, a partial wall 50 is preferably provided at each end of the inventive manifold segment 20 for completely closing off the area beneath the slots 34, including the ends of the resulting inverted V channel 35 formed beneath the abutting inner ends of the slots 34. The walls 50 thus ensure that substantially all of the exhaust gas flowing into the bottom of manifold segment 20 from the vertical manifold legs 6 travels through the catalytic converter elements 28 and collects in the open, upper longitudinal portion 30 of the manifold. The exhaust gas received in the upper longitudinal portion 30 then continues to flow in the normal manner to a turbocharger or to an exhaust stack, or is otherwise discharged.

As will thus be apparent, the inventive system provides convenient access to the catalytic elements 28 for removal, inspection, cleaning, and/or replacement without requiring that the overhead manifold or the overhead manifold segments 20 be removed. The preferred V arrangement of the catalytic elements 28 further provides a large catalyst flow area which minimizes pressure drop through the inventive system. Further, the catalytic converter elements 28 are located in close proximity to the exhaust ports of the engine so that the temperature of the exhaust as it passes through the catalytic converter elements 28 is maximized in order to improve the operation and efficiency of the converter catalyst.

As will also be understood by those in the art, the inventive system can further optionally include: (a) electrical heating elements positioned for adding additional heat to the engine exhaust in order to improve the performance of the converter elements and/or to allow the on-line regeneration of the converter catalyst and/or any filter elements used in conjunction therewith; (b) injectors, preferably positioned in the manifold legs 6, for injecting urea, ammonia, or other material to promote SCR catalyst reactions; or (c) fuel injectors, preferably positioned in the manifold legs 6, for injection fuel into the exhaust for fueling catalyst SCR reactions or to heat the exhaust for regenerating any filter elements included in the system.

Further improvements provided by the present invention are illustrated in FIGS. 4-23. These additional improvements operate to: (a) further increase the life and durability of the catalyst elements, (b) dampen and more evenly distribute the exhaust pressure pulsations experienced by the catalyst elements during engine operation, (c) more securely retain the catalyst substrate within the outer retainer of the element so that the substrate does not become loose or work its way free over time, (d) further improve the efficiency of the inventive catalytic conversion system by more evenly distributing the exhaust gas flow across and through the entire flow area of each catalyst element, and (e) eliminate movement and looseness of the catalytic converter elements themselves within the element insertion slots provided in the inventive exhaust manifold system.

Figure 4:
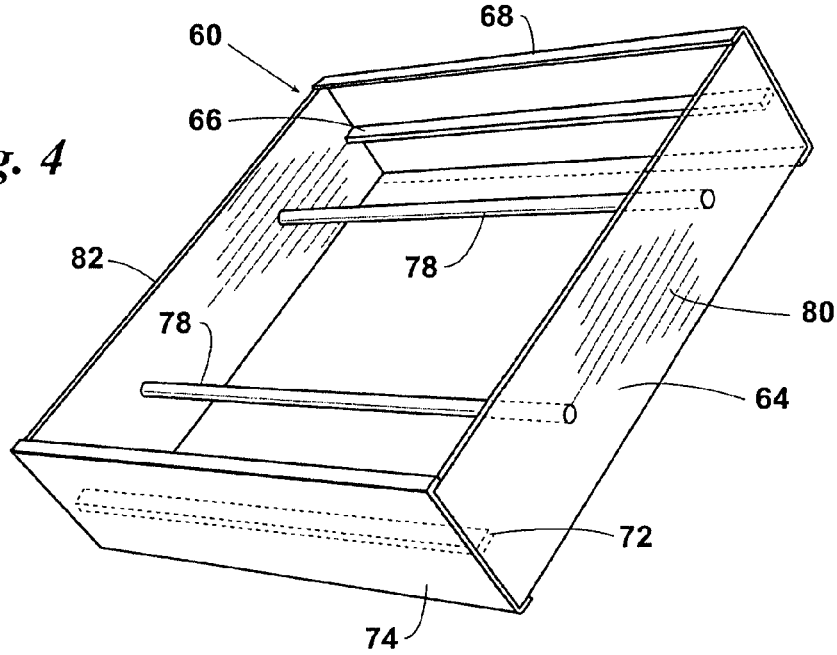
FIG. 4 is a cutaway perspective view of an inventive catalytic converter element 60.
Figure 6:
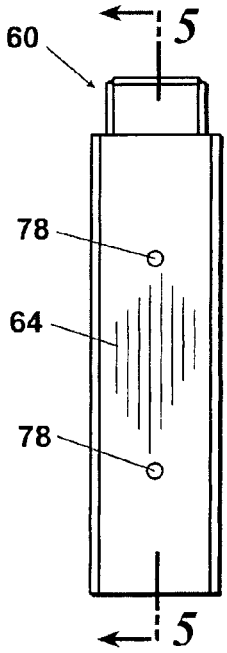
FIG. 6 is an elevational side view of the inventive catalytic converter element 60.
Figure 5:
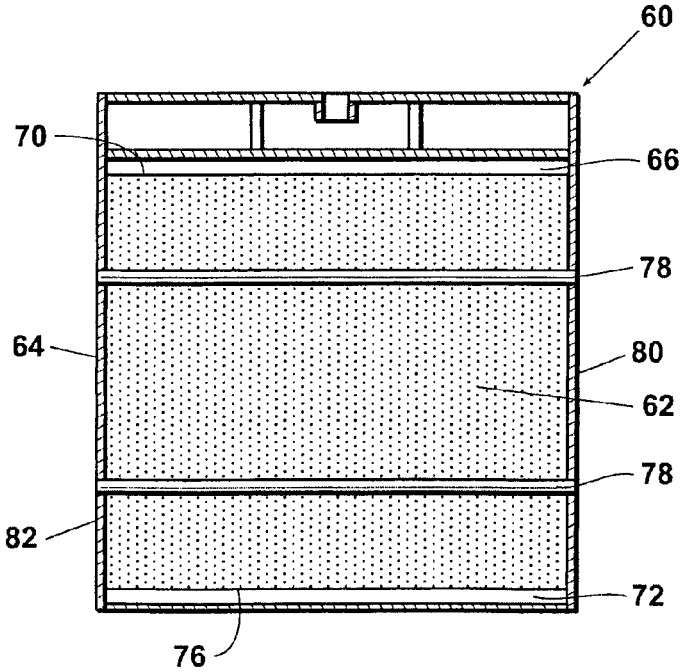
FIG. 5 is a cutaway elevational view of the inventive catalytic converter element 60 as seen from perspective 5-5 shown in FIG. 6.
Figure 7:
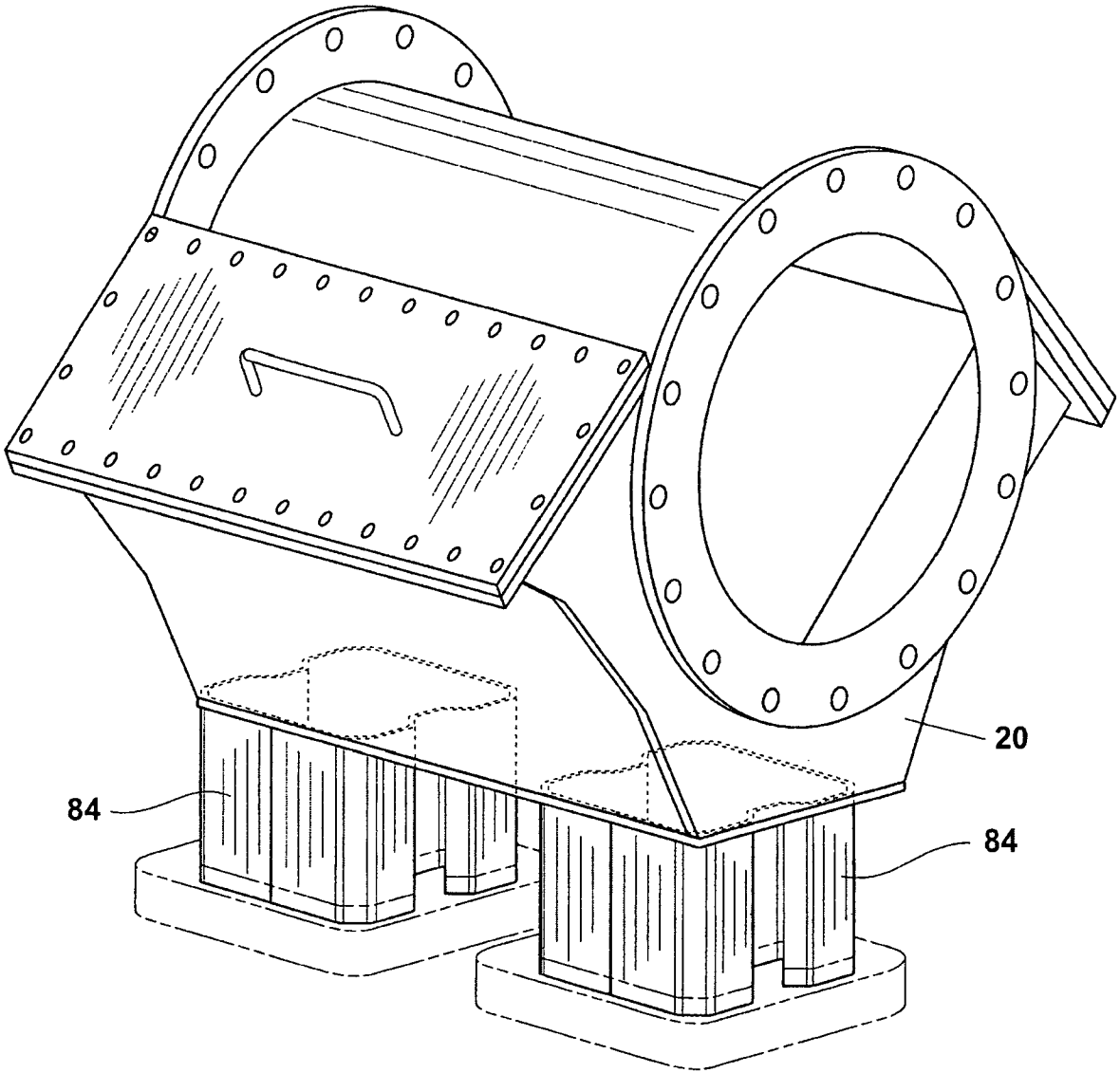
FIG. 7 is a perspective view of the inventive exhaust manifold 20 having a pair of inventive vertical combination manifold legs 84 extending thereto.
Figure 9:
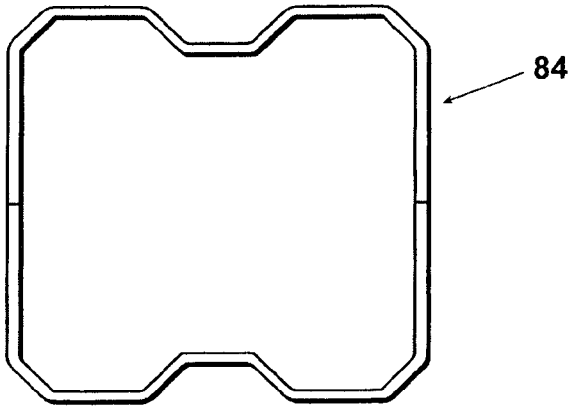
FIG. 9 is a plan view of the inventive combination manifold leg 84.
Figure 8:
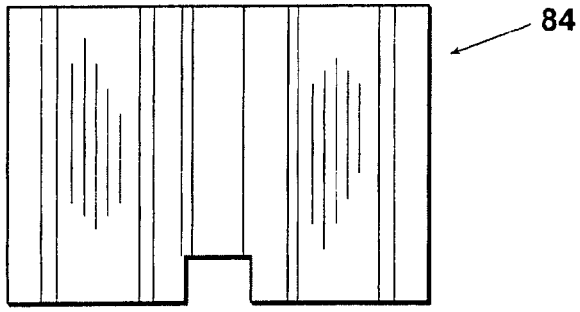
FIG. 8 is an elevational side view of the inventive combination manifold leg 84.
Figure 10:
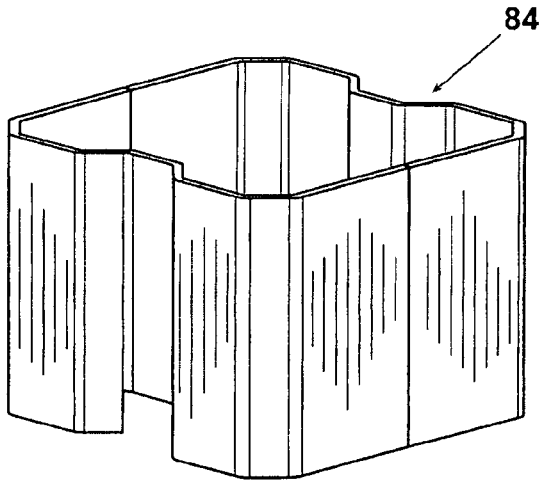
FIG. 10 is a perspective view of the inventive combination manifold leg 84.

FIGS. 4-6 illustrate another inventive embodiment 60 of a catalytic converter element which can be used in the inventive catalytic converter system as an alternative to the converter element 28 described above. The inventive catalytic converter element 60 is similar to the catalytic converter element 28 except that the catalytic converter element 60 includes additional features which further assist in retaining the substrate 62 within the outer retaining band or frame 64 and therefore assist in preventing the substrate 62 from becoming loose or breaking free because of prolonged exposure to the exhaust pressure pulses produced by the diesel engine.

The additional improvements embodied in the inventive catalytic converter element 60 include: (a) an upper retaining lip 66 which extends centrally along the length of the interior side of the upper horizontal segment 68 of the retaining band or frame 64 and projects a short distance into the horizontal top side edge 70 of the substrate 62; (b) a lower retaining lip 72 which extends centrally along the length of the interior side of the lower horizontal segment 74 of the retaining band or frame 64 and projects a short distance into the horizontal bottom side edge 76 of the substrate 62; and (c) one or more support pins 78 (preferably two parallel support pins 78) which extend horizontally through the substrate 62, each of pins 78 having one end connected to one side 80 of the retaining band or frame 64 and the other end connected to the opposite side 82 of the retainer 64. It will also be understood that retaining lips could alternatively or additionally be provided along the interior faces of the retainer side segments 80 and 82.

The interior retaining lips 66 and 72 and the support pin(s) 78 provide additional support area for the substrate 62 to push against when exposed to pressure pulses. However, the retaining lips 66 and 72 and the support pin(s) 78 do not block the flow area through the substrate 62 to any significant degree.

Figure 23:
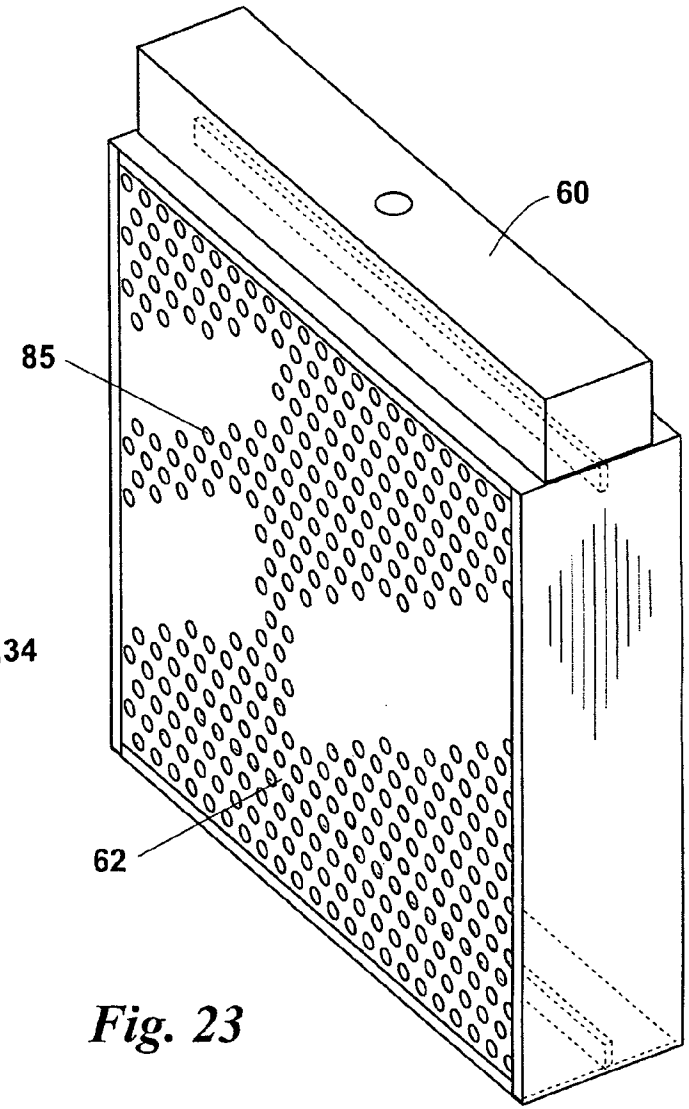
FIG. 23 illustrates the attachment of a perforated flow distribution plate 85 over the inlet or outlet face of the catalytic element substrate 62.

In another improvement, FIG. 23 illustrates the attachment of perforated flow distribution plates 85 preferably over both of the inlet and outlet faces of the substrate 62. The flow distribution plates 85 operate to hold and retain the substrate 62 within the element and also operate to dampen pressure pulses and more evenly distribute the exhaust gas flow across the entire flow area of the element.

In another improvement, FIGS. 7-10 illustrate the replacement of the opposing pairs of individual vertical manifold legs 6 heretofore used in the art with combination manifold legs 84. Each combination manifold leg 84 receives the combined exhaust flow from two opposing engine cylinders and provides a much larger and much more open flow area than is otherwise provided by the opposing pair of individual exhaust manifold legs 6. This allows the exhaust gas to expand to a much greater degree prior to reaching the overhead manifold 20. As a result, each combination manifold leg 84 helps to dampen pressure pulses and to improve the flow distribution of the exhaust gas flow through the inventive system.

In another improvement, FIGS. 11-15 illustrate the installation of perforated distribution plates 86 in the lower interior portion of the overhead exhaust manifold segments 20 between (a) the upper ends of the individual or combined vertical exhaust delivery manifolds 6 or 84 and (b) the inlet faces 88 of the catalytic converter elements 28 or 60. The perforated distribution plates 86 operate to dampen exhaust pressure pulses and better distribute the exhaust gas flow to the catalytic converter elements 28 or 60.

Figure 11:
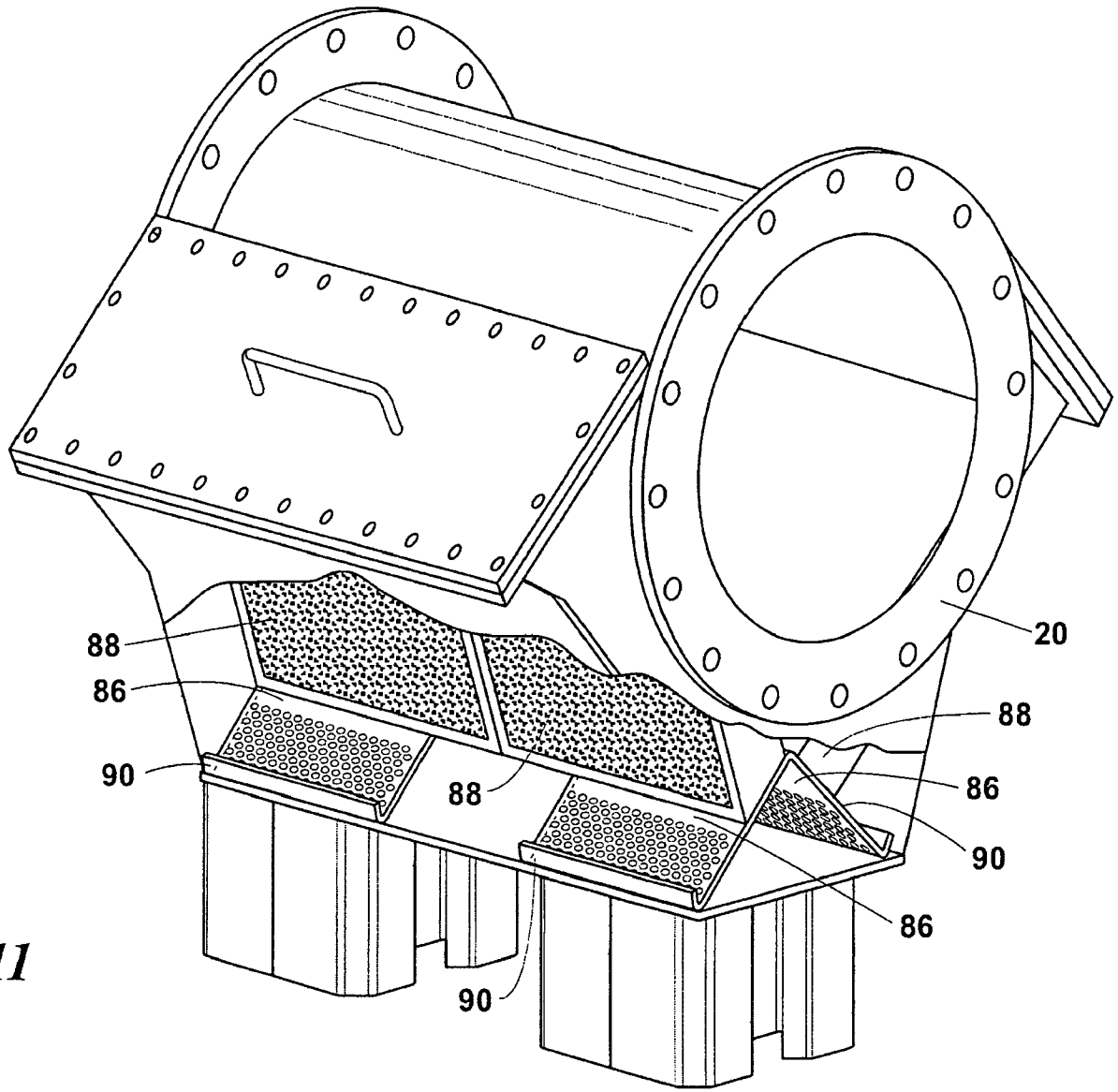
FIG. 11 is a perspective view of the inventive overhead manifold 20 have an inventive exhaust gas flow distribution structure 90 installed therein.
Figure 12:
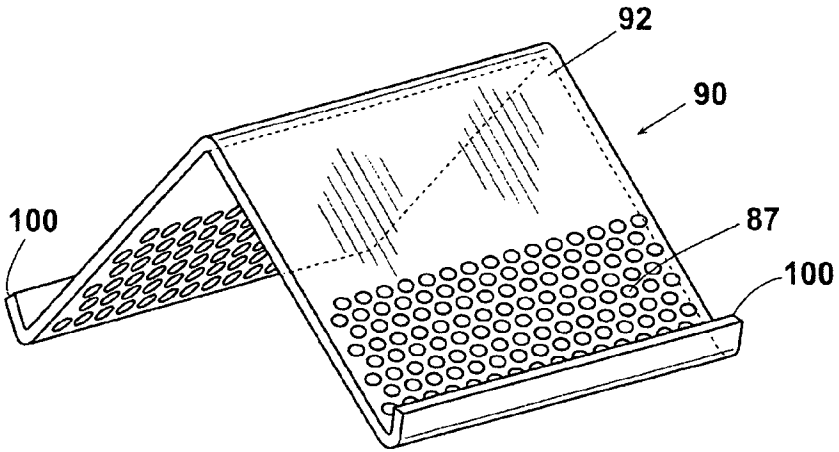
FIG. 12 is a perspective view of the inventive flow distribution structure 90.
Figure 13:
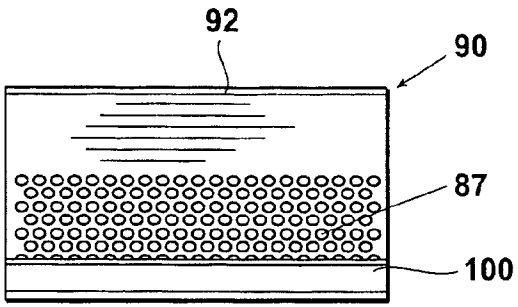
FIG. 13 is an elevational side view of the inventive flow distribution structure 90.
Figure 15:
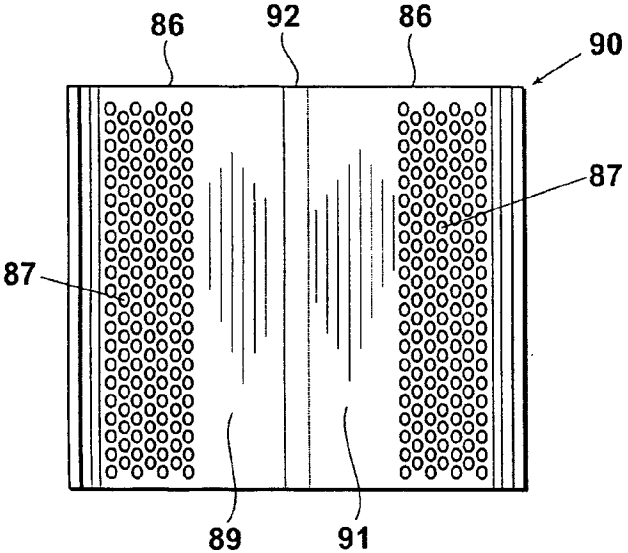
FIG. 15 is a plan view of the inventive flow distribution structure 90.
Figure 14:
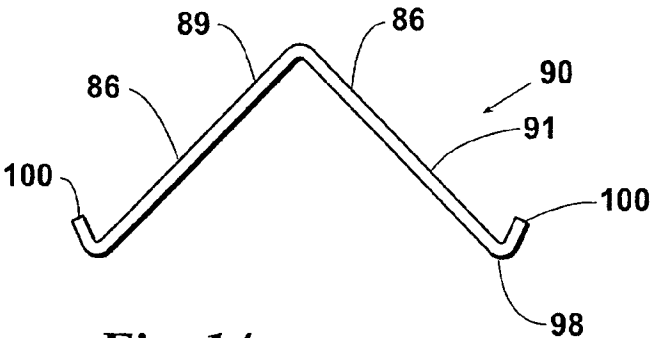
FIG. 14 is an elevational end view of the inventive flow distribution structure 90.

When the catalytic converter elements 28 or 60 are installed in opposing pairs in the inventive system in an upright V relationship as illustrated in FIG. 11, the distribution plates 86 for each pair of opposing converter elements 28 or 60 can be made and installed in the form of a combined unitary structure 90 as illustrated in FIGS. 12-15. The combined unitary flow distribution structure 90 has a tent-like cross-sectional shape with an upper, nonperforated, inverted V section 92 which sits within the inverted V channel 35 formed beneath the abutting inner ends of the element insertion slots 34. The base 98 of the combined distribution structure 90 is preferably of sufficient width to extend entirely across the inlet exhaust flow area at the upper ends of the vertical manifold legs 6 or 84 and preferably includes upturned outer ends 100 which will rest on the interior floor of the manifold segment 10.

Thus, when the elements 28 or 60 are installed in an upright V arrangement above a combined distribution structure 90, the exhaust gas flowing through the perforations 87 in the angled left side 89 of the distribution structure 90 will be directed to the left element 28 or 60 of the V arrangement and the exhaust gas flowing through the perforations 87 in the angled right side 91 of the distribution structure 90 will be directed to the right element 28 or 60 of the V.

Additional improvements which operate to further secure the catalytic converter elements 28 or 60 within the manifold segments are illustrated in FIGS. 16-22. These improvements provide means for holding the converter elements which can be used either alone or in combination and are particularly effective for preventing the catalytic converter elements 28 or 60 from moving or rattling when exposed to exhaust pressure pulses or other conditions within the exhaust system. By preventing the elements 28 or 60 from moving or rattling during operation, these improvements prolong the life and improve the durability and efficiency of the converter elements 28 and 60 and of the other system components.

Figure 16:
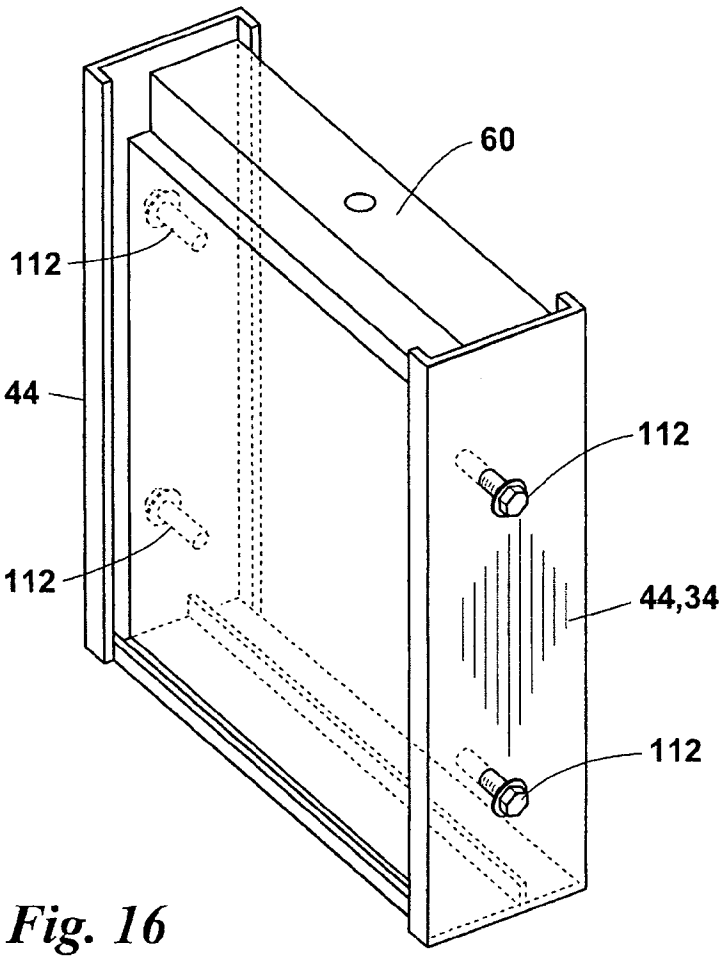
FIG. 16 illustrates the use of bolts 112 for securing the catalytic elements 28 or 60 in the insertion slots 34.

FIG. 16 illustrates the insertion of at least one pair (preferably two pair) of bolts 112 through the sidewalls 44 of the element insertion slots 34 for securing the catalytic converter elements 28 or 60 in fixed position within the slots 34.

Figure 17:
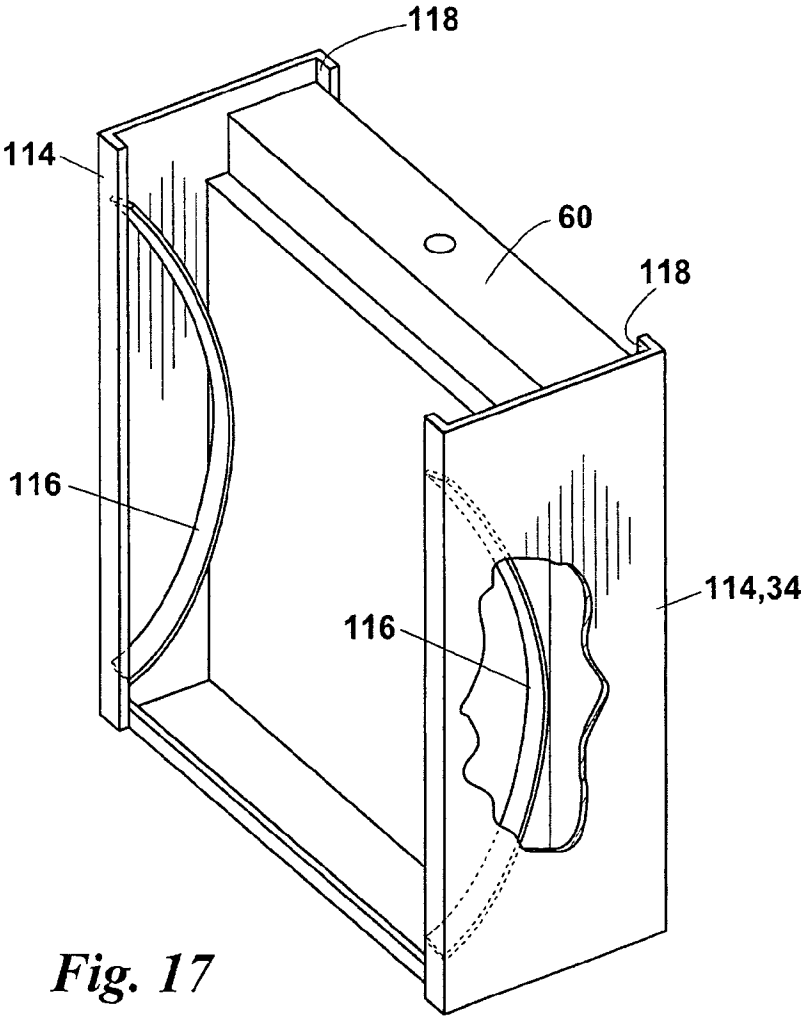
FIG. 17 illustrates the use of spring elements 116 for securing the catalytic elements 28 or 60 in the insertion slots 34.

In the embodiment shown in FIG. 17, the width of the side rails 114 of the element insertion slot 34 is increased and at least one, preferably a pair, of retaining spring(s) 116 is/are installed in one or both of the side rails 114 or elsewhere in the insertion slot 34. The retaining spring(s) 116 is/are preferably leaf springs. The springs 116 flex to allow the insertion of the elements 28 or 60 within the slots 34 but then operate to hold the elements 28 or 60 in tight engagement with the front or rear lips 118 of the slot side rails 114.

Figure 18:
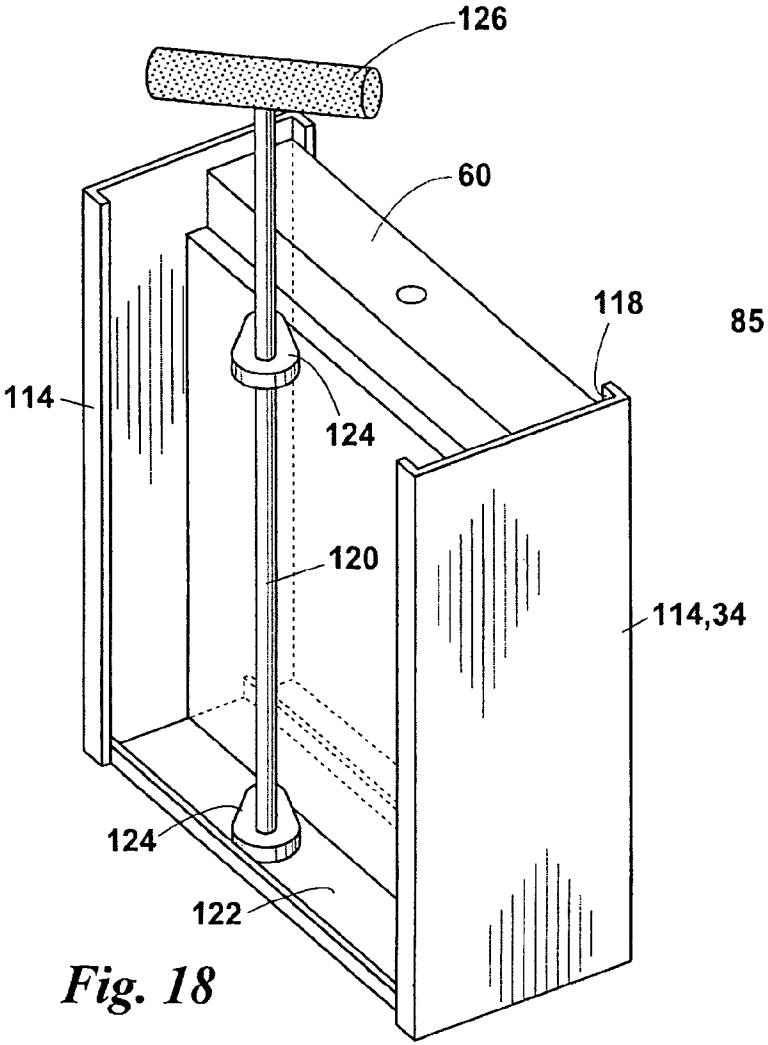
FIG. 18 illustrates the use of one or a plurality of rotatable cam elements 124 for securing the catalytic elements 28 or 60 in the insertion slots 34.
Figure 19:
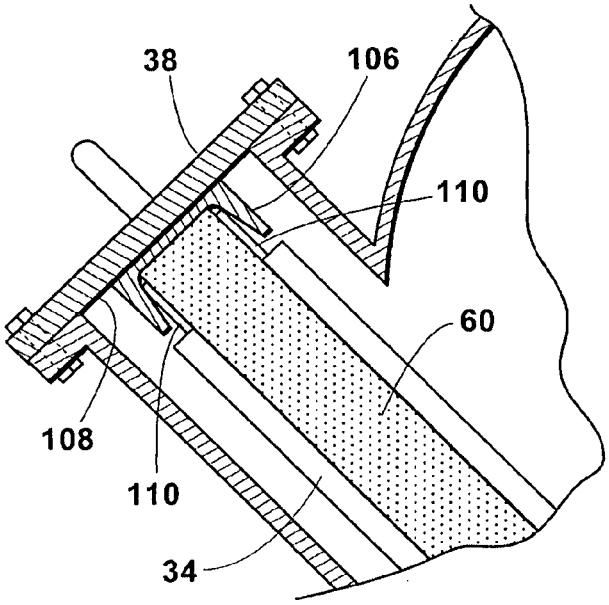
FIG. 19 is a cutaway view of an element insertion slot having an inventive cover 38 with an element stabilizer 106.
Figure 20:
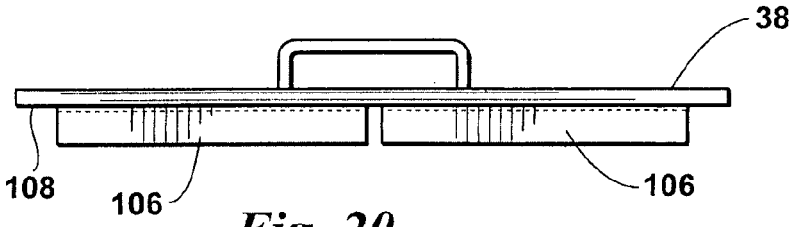
FIG. 20 is an elevational/side view of the inventive cover 38 having the stabilizer 106.
Figure 21:
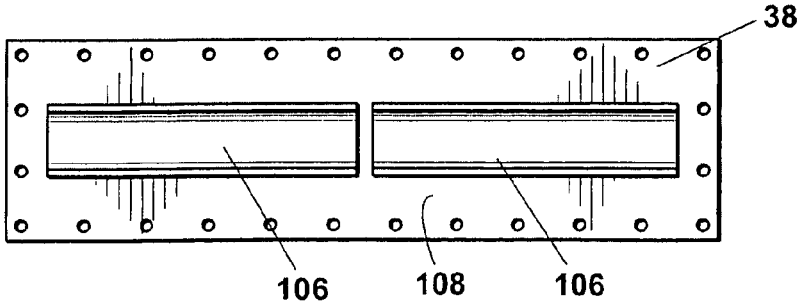
FIG. 21 is a bottom view of the inventive cover 38 having the stabilizer 106.
Figure 22:
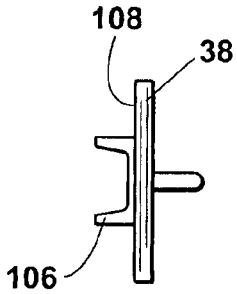
FIG. 22 is an end view of the inventive cover 38 having the stabilizer 106.

FIG. 18 illustrates another embodiment of the widened insertion slot arrangement wherein, rather than or in addition to using leaf springs, one or more rotatable cam elements 124 is/are used to hold the catalytic converter element 28 or 60 in tight engagement with the front or rear lips 118 of the slot rails 114. A cam rod 120 having a handle 126 is rotatably secured to the lower end 122 of the insertion slot 34 for rotating the cam element(s) 124 into engagement with the outlet or inlet face of the catalytic converter element 28 or 60.

FIGS. 19-22 illustrate the addition of a stabilizer 106 to the interior side 108 of the removable cover 38 of an element insertion slot 34. The retainer 106 is sized to receive and grip the outer end of the catalytic converter elements 28 or 60 in order to prevent any movement thereof. In addition, contact strips 110 can be attached across each side of the upper end of the catalytic converter element 28 or 60 in order to increase the degree of gripping tension (i.e., frictional resistance) provided between the stabilizer 106 and the converter element 28 or 60. The contacting strips 110 can be formed of the same material as the sealing gasket 40 or can be comprised of other high temperature plastic, polymer, or metal materials. Examples of suitable stabilizer structures 106 include, but are not limited to, an elongate C-channel as illustrated in FIGS. 19-22 or a flexing clip.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An apparatus for treating an engine exhaust stream comprising:

an exhaust manifold;

at least one catalytic converter element insertable in said exhaust manifold through an insert opening in said exhaust manifold;

a cover positionable on said insert opening for closing said insert opening; and said cover including a stabilizer, wherein, when said catalytic converter element is inserted into said exhaust manifold and said cover is positioned on said insert opening, said stabilizer will be received on an outer end portion of said catalytic converter element in a manner effective for at least restricting movement of said catalytic converter element in said exhaust manifold and said apparatus further comprises at least one contacting strip attached to said outer end portion of said catalytic converter element such that said stabilizer will contact said contacting strip in a manner effective for providing increased frictional resistance between said stabilizer and said outer end portion of said catalytic converter element.

2. The apparatus of claim 1 wherein said stabilizer comprises an elongate C-channel for receiving said outer end portion of said catalytic converter element.

* * * * *